US007956263B1

(12) United States Patent
Volk, Jr. et al.

(10) Patent No.: US 7,956,263 B1
(45) Date of Patent: Jun. 7, 2011

(54) CAPO SYSTEMS

(75) Inventors: Michael Douglas Volk, Jr., Phoenix, AZ (US); Kenneth Dale Suomala, Chandler, AZ (US); Zachary B. Smith, Phoenix, AZ (US)

(73) Assignee: Michael D. Volk, Jr., San Antonio, TX (US)

( * ) Notice: Subject to any disclaimer, the term of this patent is extended or adjusted under 35 U.S.C. 154(b) by 0 days.

(21) Appl. No.: 12/689,204

(22) Filed: Jan. 18, 2010

Related U.S. Application Data

(60) Provisional application No. 61/145,374, filed on Jan. 16, 2009.

(51) Int. Cl.
*G10D 3/00* (2006.01)

(52) U.S. Cl. ..... 84/318

(58) Field of Classification Search ..... 84/318
See application file for complete search history.

(56) References Cited

U.S. PATENT DOCUMENTS

| | | | | |
|---|---|---|---|---|
| 3,662,641 | A | 5/1972 | Allen et al. | |
| 3,933,077 | A * | 1/1976 | Dunlop | 84/318 |
| 4,128,034 | A | 12/1978 | Myerson et al. | |
| 4,149,443 | A | 4/1979 | Bringe | |
| 4,250,790 | A | 2/1981 | Shubb et al. | |
| 4,270,432 | A * | 6/1981 | Wilkerson | 84/318 |
| 4,658,690 | A | 4/1987 | Aitken et al. | |
| 4,671,156 | A * | 6/1987 | Hathcock | 84/318 |
| 4,793,234 | A | 12/1988 | Geis | |
| 4,856,404 | A | 8/1989 | Hughes, Sr. | |
| 5,284,077 | A * | 2/1994 | Ellis | 84/318 |
| D365,118 | S | 12/1995 | Kyser | |
| 5,492,045 | A | 2/1996 | Roblee | |
| D372,259 | S | 7/1996 | Kyser | |
| 5,623,110 | A | 4/1997 | Hoglund et al. | |
| 5,792,969 | A | 8/1998 | Shubb et al. | |
| 6,528,711 | B1 | 3/2003 | Paige | |
| 6,635,813 | B2 | 10/2003 | Campling | |
| 6,835,880 | B1 | 12/2004 | Silva | |
| 6,958,439 | B1 * | 10/2005 | White | 84/318 |
| 6,998,526 | B1 | 2/2006 | Sims et al. | |
| D533,211 | S | 12/2006 | Kyser | |
| 7,390,948 | B2 * | 6/2008 | Walworth | 84/318 |
| 7,511,208 | B1 | 3/2009 | Kyser | |
| 2001/0027711 | A1 | 10/2001 | Campling | |
| 2004/0261600 | A1 | 12/2004 | Silva | |
| 2005/0087056 | A1 | 4/2005 | Zager, Jr. et al. | |
| 2006/0075879 | A1 | 4/2006 | Ushinski | |
| 2007/0107580 | A1 | 5/2007 | Vleugels | |
| 2007/0143929 | A1 | 6/2007 | Selin | |
| 2009/0064842 | A1 | 3/2009 | Small | |

FOREIGN PATENT DOCUMENTS

| | | | |
|---|---|---|---|
| DE | 10037761 | A1 * | 2/2002 |
| EP | 012545 | A1 | 11/1984 |
| EP | 0038845 | B1 | 4/1986 |
| EP | 0979501 | B1 | 2/2000 |
| EP | 1143408 | A2 | 10/2001 |
| EP | 1143408 | B1 | 10/2001 |
| WO | 8101215 | A1 | 4/1981 |
| WO | 8404619 | A1 | 11/1984 |
| WO | 8906034 | A1 | 6/1989 |
| WO | 9849669 | A1 | 11/1998 |
| WO | 0055840 | A1 | 9/2000 |

* cited by examiner

*Primary Examiner* — Elvin G Enad
*Assistant Examiner* — Robert W Horn
(74) *Attorney, Agent, or Firm* — Michael D. Volk, Jr.

(57) ABSTRACT

A capo system for stringed instruments, in particular, guitars. A preferred embodiment of the system comprises a clamping assembly in combination with an under-string deflection limiter configured to limit deflection of the strings when clamped.

12 Claims, 3 Drawing Sheets

CAPO SYSTEMS

CROSS-REFERENCE TO RELATED APPLICATION

The present application is related to and claims priority from prior provisional application Ser. No. 61/145,374, filed Jan. 16, 2009, entitled "CAPO SYSTEMS" which is incorporated herein by this reference and is not admitted to be prior art with respect to the present invention by the mention in this cross-reference section.

BACKGROUND

This invention relates to providing capo systems. More particularly this invention relates to providing capo systems for stringed instruments, in particular, guitars.

A capo is a device used to shorten the effective string length of a stringed instrument which raises the pitch of the instrument. Capos, sometimes variously termed capodastros, capodasters, capo tastos, or cedillas, are customarily used to change the key and pitch of the open strings of a stringed instrument without having to adjust the tension of the strings with the tuning keys of the instrument.

It is noted that when a capo is used on a guitar, the clamping function of the capo "stretches" the strings down upon fretwire of the guitar and further against the fretboard of the guitar. This is undesired as it can likely lead to problems with the tuning of the guitar, among others.

OBJECTS AND FEATURES OF THE INVENTION

A primary object and feature of the present invention is to provide a capo system that provides an element that assists in preventing stretching of the strings against the fretboard when the capo is applied. A further primary object and feature of the present invention is to provide such a system that is efficient, inexpensive, and handy. Other objects and features of this invention will become apparent with reference to the following descriptions.

SUMMARY OF THE INVENTION

In accordance with a preferred embodiment hereof, this invention provides a capo system for use with a guitar having at least one guitar string and a guitar neck having a fretboard and back portion, such system comprising: at least one clamp configured to releasably clamp the at least one guitar string against a fret of the fretboard; at least one under-string deflection limiter configured to limit downward deflection of the at least one guitar string toward the fretboard by the at least one clamp, the at least one under-string deflection limiter being situate between at least two frets of the fretboard; and wherein the at least one under-string deflection limiter is configured to contemporaneously contact the fretboard and the at least one guitar string.

Moreover, it provides such a capo system wherein such at least one under-string deflection limiter is movably coupled to such at least one clamp. Additionally, it provides such a capo system wherein such at least one under-string deflection limiter comprises at least one elongated flexible member. Also, it provides such a capo system wherein such at least one elongated flexible member comprises a thickness of not more than the height of the fret projecting outwardly from the fretboard. In addition, it provides such a capo system wherein such at least one elongated flexible member comprises a thickness of not more than the projecting height of the fret as measured from the fretboard. And, it provides such a capo system wherein such at least one elongated flexible member comprises a length about equal to the width of the fretboard. Further, it provides such a capo system wherein such clamp comprises: at least one string-engaging portion to engage the at least one guitar string; pivotally coupled to such at least one string engaging portion, at least one neck-engaging portion to engage a back portion of the guitar neck; and at least one spring biaser configured to bias such at least one neck-engaging portion toward such at least one string-engaging portion.

Even further, it provides such a capo system wherein such at least one spring biaser comprises at least one torsion spring having at least one first wire leg configured to operably engage such at least one string engaging portion and at least one second leg configured to operably engage such at least one neck-engaging portion. Even further, it provides such a capo system wherein such at least one elongated flexible member comprise at least one coupler configured to couple such at least one elongated flexible member to at least one of such at least one first wire leg or such at least one second leg. Even further, it provides such a capo system wherein such at least one coupler comprises: within such at least one elongated flexible member, at least one aperture configured to movably engage either one of such at least one first wire leg or such at least one second leg; wherein such at least one aperture of such at least one elongated flexible member is movably engaged on at least one of such at least one first wire leg or such at least one second leg.

Even further, it provides such a capo system wherein: such at least one string-engaging portion comprises at least one first grip configured to assist hand manipulation of such at least one string-engaging portion; and such at least one neck-engaging portion comprises at least one second grip configured to assist hand manipulation of such at least one neck-engaging portion. In accordance with another preferred embodiment hereof, this invention provides a capo system for use with a guitar having at least one guitar string and a guitar neck having a fretboard and back portion, such system comprising: clamp means for releasably clamping the at least one guitar string against a fret of the fretboard; deflection limiter means for limiting downward deflection of the at least one guitar string toward the fretboard during such clamping; wherein such deflection limiter means is situate between at least two such frets of the fretboard; and wherein such deflection limiter means is configured to contemporaneously contact the fretboard and the at least one guitar string.

In accordance with another preferred embodiment hereof, this invention provides a capo apparatus for use with a guitar having a plurality of guitar strings and a guitar neck having a fretboard and back portion, such system comprising: a capo configured to releasably press the plurality of guitar strings against a fret of the fretboard; moveably coupled to such capo, at least one under-string member configured to support the plurality of guitar strings above the fretboard during such pressing by the capo; wherein such at least one under-string member is configured to be positionable between at least two such frets of the fretboard; and wherein such at least one under-string member is configured to supportively contact both the fretboard and the plurality of guitar string during such pressing.

In accordance with another preferred embodiment hereof, this invention provides a capo system for use with a guitar having at least one guitar string and a guitar neck having a fretboard and back portion, such system comprising: at least one capo configured to releasably clamp the at least one guitar string against a fret of the fretboard; wherein such at least one capo comprises at least one string-engaging portion to engage the at least one guitar string; wherein such at least one string-engaging portion comprises: at least one outwardly projecting wall having at least one peripheral notch configured to engage the at least one guitar string therein, and adjacent such at least one outwardly projecting wall at least one resilient pad configured to resiliently press the at least one guitar string against the fret; and wherein such at least one peripheral notch allows limited transverse movement of the at least one guitar string relative to the fretboard. Furthermore, it provides each and every novel feature, element, combination, step and/or method disclosed or suggested by this patent application.

DETAILED DESCRIPTION OF THE BEST MODES AND PREFERRED EMBODIMENTS OF THE INVENTION

Figure 1:
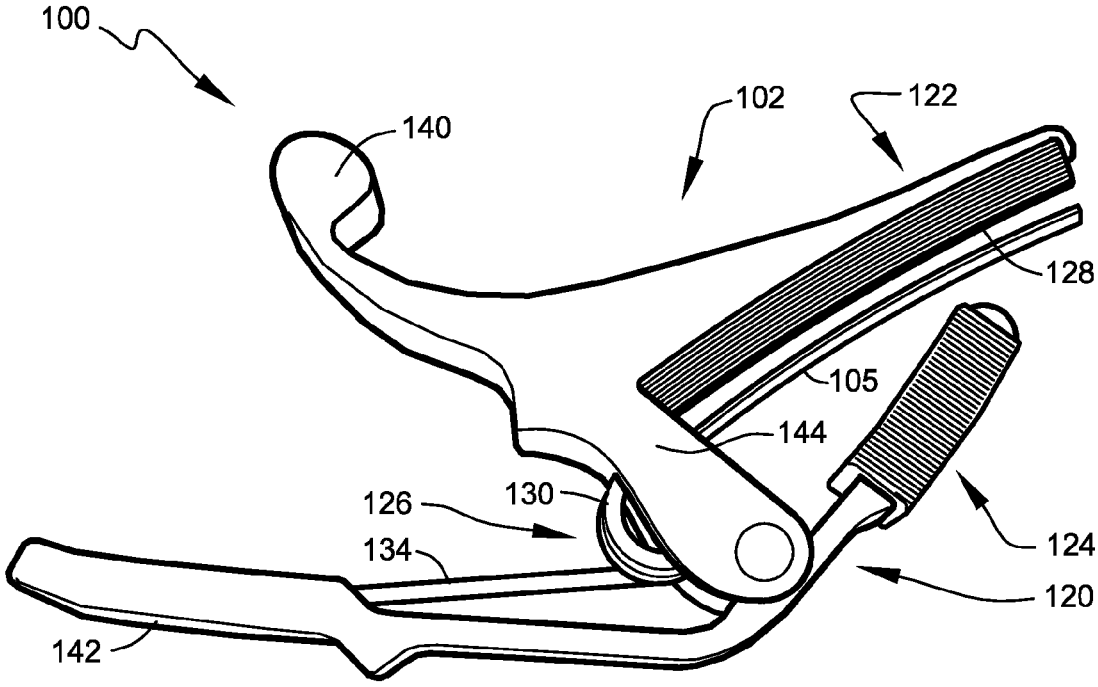
FIG. 1 shows a perspective view, illustrating an enhanced capo, according to a preferred embodiment of the present invention.
Figure 2:
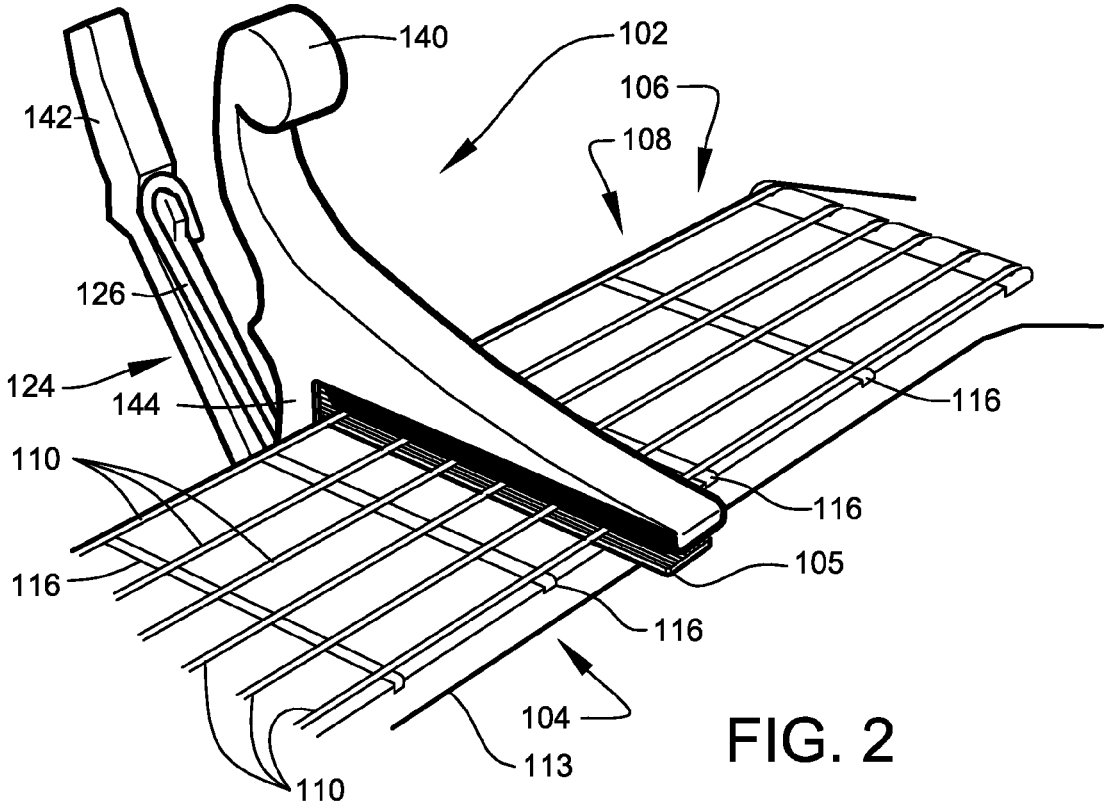
FIG. 2 shows a perspective view, illustrating the enhanced capo of FIG. 1 in an operating position mounted to the neck of a stringed instrument.

FIG. 1 shows a perspective view, illustrating an enhanced capo 102, according to a preferred embodiment of capo system 100. FIG. 2 shows a perspective view, illustrating the enhanced capo 102 of FIG. 1 mounted to neck 104 of stringed instrument 106. It is noted that stringed instrument 106 preferably comprises a guitar, as shown. Upon reading this specification, those with ordinary skill in the art will now appreciate that, under appropriate circumstances, considering such issues as user preference, etc., the use of the system with other fretted stringed instruments such as, for example, banjos, mandolins, dulcimers, fretted basses, or similar, etc., may suffice.

Enhanced capo 102 is preferably configured to temporarily shorten the effective string length of stringed instrument 106, which results in raising the pitch of the instrument. Enhanced capo 102 is preferably configured to change the key and pitch of the open strings of the fretted instrument without having to adjust the tension of the strings.

Enhanced capo 102 is preferably configured for use with at least one fretted stringed instrument 106, preferably including guitar 108, as shown. Guitar 108 preferably comprises the customary plurality of guitar strings 110 extending the length of neck 104, as shown. The neck 104 preferably comprises a lower back portion 113 located generally opposite an upper fingerboard identified herein as fretboard 114. Fretboard 114 contains a plurality of spaced-apart frets 116, projecting upwardly from fretboard 114 and oriented generally perpendicular to guitar strings 110, as shown.

Enhanced capo 102 preferably comprises at least one clamp assembly 120 configured to releasably clamp guitar strings 110 against an adjacent fret 116 of fretboard 114, as shown. Clamp assembly 120 preferably comprises at least one string-engaging portion 122 to engage the guitar strings 110, as shown.

Pivotally coupled to string engaging portion 122 is at least one neck-engaging portion 124 to engage back portion 113 of neck 104, as shown. At least one spring biaser 126 is preferably used to bias neck-engaging portion 124 toward string-engaging portion 122, thereby enabling clamp assembly 120 to press guitar strings 110 downwardly against a fret 116.

Enhanced capo 102 preferably comprises at least one under-string element 105 located between string-engaging portion 122 and neck-engaging portion 124, as shown. In use, under-string element 105 is preferably positioned between guitar strings 110 and fretboard 114, as shown. More specifically, under-string element 105 is preferably configured to be situated between at least two adjacent frets 116 of fretboard 114 and is preferably configured to contemporaneously contact both the fretboard 114 and the guitar strings 110 during clamping, as best shown in the side view of FIG. 3. Under-string element 105 preferably comprises an orientation generally parallel to the resilient string contact surface 128 of string-engaging portion 122, as shown.

Under-string element 105 preferably functions as a deflection limiter, preferably limiting downward deflection of the guitar strings 110 toward fretboard 114 during such clamping. In this highly preferred arrangement, excessive downward bending of the strings toward fretboard 114 is all but avoided. This greatly reduces the amount of undesired "stretching" of the strings, which often compromises the tuning of the instrument. Upon reading the teachings of this specification, those of ordinary skill in the art will now understand that, under appropriate circumstances, the under-string element of the present invention may be incorporated into any number of commercial capo products such as, for example, the KYSER 6-String Acoustic #16133 capo, KYSER Electric #16135 capo, SHUBB DELUXE lines of capos, SHUBB ORIGINAL line of capos, DUNLOP line of capos (TRIGGER capo, elastic capos, etc.), etc.

Figure 3:
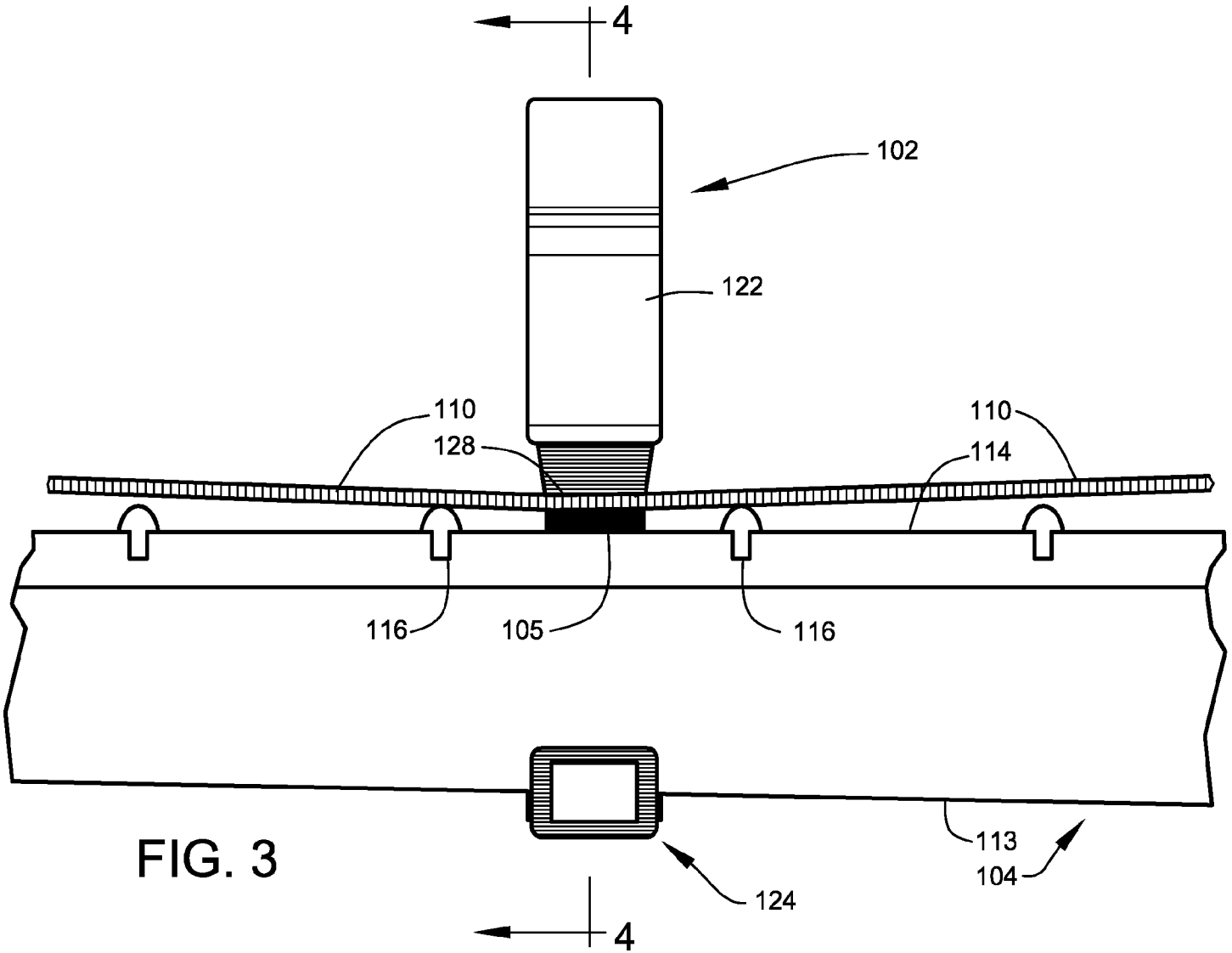
FIG. 3 shows a side view further illustrating the preferred operation of the enhanced capo of FIG. 1.
Figure 4:
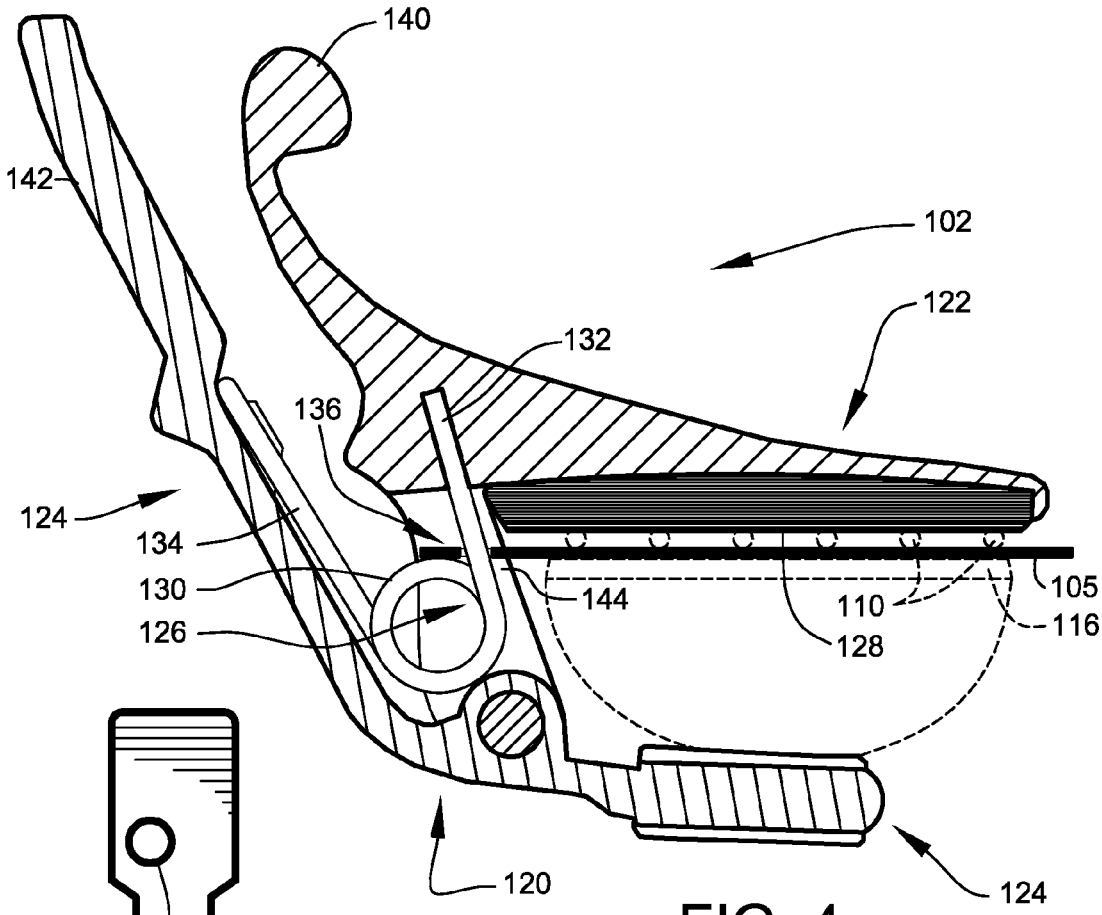
FIG. 4 shows the sectional view 4-4 of FIG. 3 according to the preferred embodiment of FIG. 1.

FIG. 4 shows the sectional view 4-4 of FIG. 3 according to the preferred embodiment of FIG. 1.

Figure 5:
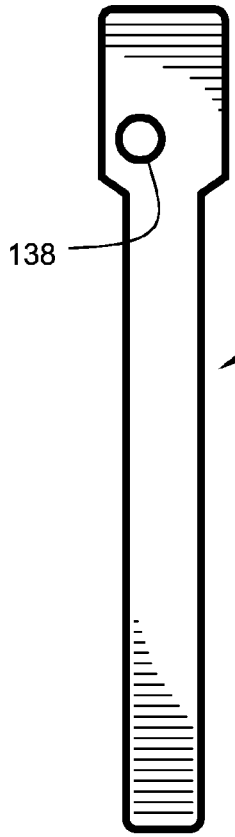
FIG. 5 shows a plan view of an under-string support member, according to the preferred embodiment of FIG. 1.

FIG. 5 shows a plan view of the preferred under-string element 105, according to the preferred embodiment of FIG. 1. Under-string element 105 (at least embodying herein at least one under-string deflection limiter) preferably comprises at least one elongated flexible member, as shown, and preferably comprises a thickness of not more than the projecting height of the fret as measured from the fretboard 114. Under-string element 105 preferably comprises a length about equal to the width of the fretboard (i.e., the dimension perpendicular to the longitudinal length of the neck), as shown. Upon reading the teachings of this specification, those of ordinary skill in the art will now understand that, under appropriate circumstances, considering issues such as intended use, use with "partial-capos", instrument dimensions, other lengths for under-string element, such as lengths sufficient to extend under one string, two strings, top and bottom strings, more than six strings, etc., may suffice.

Flexible under-string element 105 may overhang the distal end of string contact surface 128, as shown, to assist in guiding under-string element 105 under guitar strings 110. Alternately preferably, the length of under-string element 105 may be sized to essentially match string contact surface 128. Preferred embodiments of under-string element 105 are preferably constructed from a durable and flexible plastic, preferably polypropylene. A preferred textured top surface of under-string element 105 functions to hide markings from guitar strings 110.

Spring biaser 126 of enhanced capo 102 preferably comprises at least one torsion spring 130 having at a first wire leg 132 preferably configured to firmly engage string engaging portion 122 and a second wire leg 134 configured to firmly engage neck-engaging portion 124, as shown. A preferred torsion spring 130 preferably comprises music wire per ASTM A228 having a wire diameter of about 0.090 inch, an outside coil diameter of about 0.535 inch, about 2.25 total number of coils, a leg length of about 2 inches, a free angle of about 90 degrees, rate/degree of about 0.506 pounds per degree, a rate per turn of about 182 pounds, a torque at deflection 1 of about 10.112 inch-pounds at an angle of 110 degrees, a torque at deflection 2 of about 25.281 inch-pounds at an angle of 140 degrees, a stress at deflection 1 of about 50.56%, and a stress at deflection 2: 126.41%. Under appropriate circumstances, other spring specifications may suffice.

Preferably, under-string element 105 is preferably coupled to enhanced capo 102 (at least embodying herein such at least one clamp) by at least one coupler assembly 136. It is preferred that under-string element 105 be movable in an approximately vertical direction to permit adjustment to the spacing between under-string element 105 and string contact surface 128 (preferably an elongated rubber pad). Coupler assembly 136 is preferably configured to couple the elongated flexible member to at least one of such at least one of first wire leg 132 or second wire leg 134, most preferably first wire leg 132, as shown.

Coupler assembly 136 preferably comprises aperture 138 having an inner diameter configured to movably engage either one of the wire legs. Preferably, under-string element 105 is coupled to the main assembly by the engagement of aperture 138 on first wire leg 132, as shown (at least embodying herein wherein such at least one aperture of such at least one elongated flexible member is movably engaged on at least one of such at least one first wire leg or such at least one second leg). Thus, under-string element 105 is preferably anchored by the spring leg penetrating through the hole in the end of the member, as shown. Upon reading this specification, those with ordinary skill in the art will now appreciate that, under appropriate circumstances, considering such issues as cost, user preference, etc., other coupler arrangements such as, for example, snap-in slots allowing quick replacement/removal, clamps, keyed slots, etc., may suffice.

It is also preferred that under-string element 105 be restrained from side-to-side movement, which would misalign under-string element 105 and string contact surface 128. Under-string element 105 is preferably stabilized from such side-to-side movement by a set of adjacent walls 144 of string-engaging portion 122 adjoining each side of under-string element 105 preventing the flexible member from "wiggling" in the side-to-side direction.

String-engaging portion 122 preferably comprises at least one first grip 140 configured to assist hand manipulation of string-engaging portion 122. Similarly, neck-engaging portion 124 preferably comprises at least one second grip 142 configured to assist hand manipulation of neck-engaging portion 124.

Figure 6:
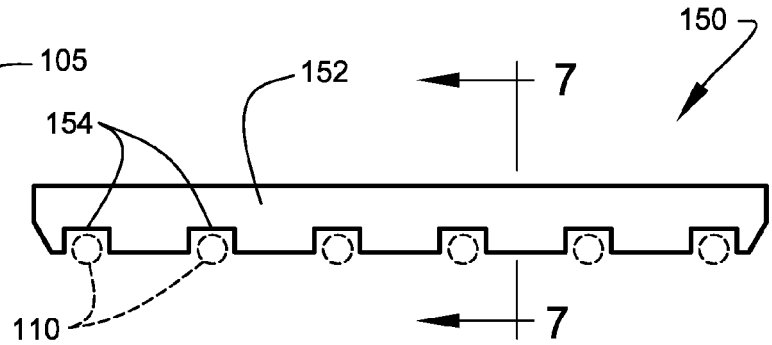
FIG. 6 shows a side view, showing a string-engaging member, according to a preferred embodiment of the present invention.
Figure 7:
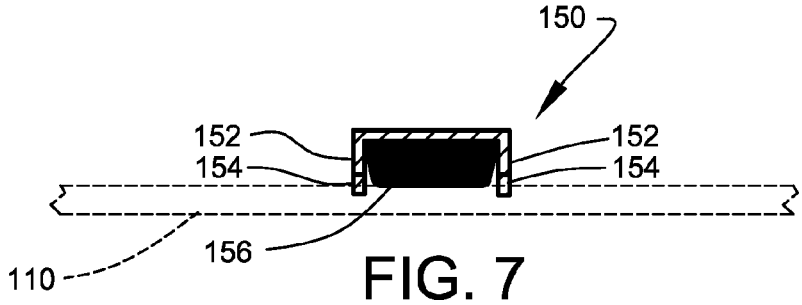
FIG. 7 shows the sectional view 7-7 of FIG. 6 further illustrating the preferred alternate embodiment of FIG. 6.

FIG. 6 shows a side view, showing an alternate string-engaging member 150, according to another preferred embodiment of the present invention. FIG. 7 shows the sectional view 7-7 of FIG. 6 further illustrating the preferred alternate embodiment of FIG. 6.

String-engaging member 150 is preferably configured to engage the guitar strings 110 in a manner similar to string contact surface 128. String-engaging member 150 is preferably used in combination with the previously disclosed embodiment. Alternate string-engaging member 150 preferably differs in design in that the assembly preferably comprises at least one outwardly projecting rigid wall, preferably a pair of parallel rigid walls 152 having a plurality of peripheral notches 154 configured to engage the guitar strings 110 therein, as shown. Each notch 154 preferably surrounds the guitar strings 110 to allow only a limited transverse movement of the strings relative to fretboard 114 thereby preventing strings from slipping from their intended position when a player engages in string bending techniques.

An elongated resilient (rubber) pad 156 is preferably located between the outwardly projecting walls 152, as shown. Resilient pad 156 is preferably configured to resiliently press the guitar strings 110 against the fret 116.

Applicant incorporates by reference, in its entirety, the specification and drawings filed in Provisional Patent Application No. 61/145,374, filed Jan. 16, 2009, entitled "CAPO SYSTEMS".

Many thanks to Stoneman Volk Patent Group, 888-252-2200, http://www.patentdoc.com/, and Zach Smith of Zach Smith Design, http://www.zachsmithdesign.com/.

Although applicant has described applicant's preferred embodiments of this invention, it will be understood that the broadest scope of this invention includes modifications such as diverse shapes, sizes, and materials. Such scope is limited only by the below claims as read in connection with the above specification. Further, many other advantages of applicant's invention will be apparent to those skilled in the art from the above descriptions and the below claims.

What is claimed is:

1. A capo system for use with a guitar having at least one guitar string and a guitar neck having a fretboard and back portion, said system comprising:

a) at least one clamp configured to releasably clamp the at least one guitar string against a fret of the fretboard;

b) at least one under-string deflection limiter configured to limit downward deflection of the at least one guitar string toward the fretboard by said at least one clamp, said at least one under-string deflection limiter being situate between at least two frets of the fretboard; and c) wherein said at least one under-string deflection limiter is configured to contemporaneously contact the fretboard and the at least one guitar string.

2. The capo system according to claim 1 wherein said at least one under-string deflection limiter is movably coupled to said at least one clamp.

3. The capo system according to claim 2 wherein said at least one under-string deflection limiter comprises at least one elongated flexible member.

4. The capo system according to claim 3 wherein said at least one elongated flexible member comprises a thickness of not more than the projecting height of the fret as measured from the fretboard.

5. The capo system according to claim 3 wherein said at least one elongated flexible member comprises a length at least about equal to the width of the fretboard.

6. The capo system according to claim 3 wherein said clamp comprises:

a) at least one string-engaging portion to engage the at least one guitar string;

b) pivotally coupled to said at least one string engaging portion, at least one neck-engaging portion to engage a back portion of the guitar neck; and c) at least one spring biaser configured to bias said at least one neck-engaging portion toward said at least one string-engaging portion.

7. The capo system according to claim 3 wherein said at least one spring biaser comprises at least one torsion spring having at least one first wire leg configured to operably engage said at least one string engaging portion and at least one second wire leg configured to operably engage said at least one neck-engaging portion.

8. The capo system according to claim 7 wherein said at least one elongated flexible member comprise at least one coupler configured to couple said at least one elongated flexible member to at least one of said at least one first wire leg or said at least one second wire leg.

9. The capo system according to claim 8 wherein said at least one coupler comprises:

a) within said at least one elongated flexible member, at least one aperture configured to movably engage either one of said at least one first wire leg or said at least one second wire leg;

b) wherein said at least one aperture of said at least one elongated flexible member is engaged on at least one of said at least one first wire leg or said at least one second wire leg.

10. The capo system according to claim 9 wherein:

a) said at least one string-engaging portion comprises at least one first grip configured to assist hand manipulation of said at least one string-engaging portion; and b) said at least one neck-engaging portion comprises at least one second grip configured to assist hand manipulation of said at least one neck-engaging portion.

11. A capo apparatus for use with a guitar having a plurality of guitar strings and a guitar neck having a fretboard and back portion, said system comprising:

a) a capo configured to releasably press the plurality of guitar strings against a fret of the fretboard;

b) moveably coupled to said capo, at least one under-string member configured to support the plurality of guitar strings above the fretboard during such pressing by the capo;

c) wherein said at least one under-string member is configured to be positionable between at least two such frets of the fretboard; and d) wherein said at least one under-string member is configured to supportively contact both the fretboard and the plurality of guitar string during such pressing.

12. A capo system for use with a guitar having at least one guitar string and a guitar neck having a fretboard and back portion, said system comprising:

a) at least one capo configured to releasably clamp the at least one guitar string against a fret of the fretboard;

b) wherein said at least one capo comprises at least one string-engaging portion to engage the at least one guitar string;

c) wherein said at least one string-engaging portion comprises:

i) at least one outwardly projecting wall having at least one peripheral notch configured to engage the at least one guitar string therein, and ii) adjacent said at least one outwardly projecting wall at least one resilient pad configured to resiliently press the at least one guitar string against the fret; and d) wherein said at least one peripheral notch allows limited transverse movement of the at least one guitar string relative to the fretboard.

* * * * *